US007246584B2

(12) United States Patent
Geiger et al.

(10) Patent No.: US 7,246,584 B2
(45) Date of Patent: Jul. 24, 2007

(54) FORCE-TRANSMITTING ARRANGEMENT FOR A VALVE TRAIN OF AN INTERNAL-COMBUSTION ENGINE

(75) Inventors: Uwe Geiger, Kleinmachnow (DE); Friedrich Hieronymus, Willmersbach (DE)

(73) Assignee: Schaeffler KG, Herzogenaurach (DE)

( * ) Notice: Subject to any disclaimer, the term of this patent is extended or adjusted under 35 U.S.C. 154(b) by 9 days.

(21) Appl. No.: 11/287,852

(22) Filed: Nov. 28, 2005

(65) Prior Publication Data

US 2006/0137641 A1 Jun. 29, 2006

Related U.S. Application Data

(60) Provisional application No. 60/640,070, filed on Dec. 29, 2004.

(51) Int. Cl.
*F01L 1/14* (2006.01)

(52) U.S. Cl. ..... 123/90.48; 123/90.52; 123/90.55; 123/90.56; 123/198 F

(58) Field of Classification Search ..... 123/90.48
See application file for complete search history.

(56) References Cited

U.S. PATENT DOCUMENTS

| | | | | |
|---|---|---|---|---|
| 2,688,319 | A | 9/1954 | Humphreys | |
| 4,462,364 | A | 7/1984 | Kodama | |
| 6,213,076 | B1 * | 4/2001 | Fischer et al. | 123/90.55 |
| 6,718,923 | B2 * | 4/2004 | Barth et al. | 123/90.55 |
| 6,748,914 | B2 | 6/2004 | Spath et al. | |
| 7,077,090 | B2 * | 7/2006 | Sailer et al. | 123/90.52 |

FOREIGN PATENT DOCUMENTS

| | | |
|---|---|---|
| DE | 197 54 016 | 6/1999 |

* cited by examiner

*Primary Examiner*—Thomas Denion
*Assistant Examiner*—Kyle M. Riddle
(74) *Attorney, Agent, or Firm*—Volpe and Koenig, P.C.

(57) ABSTRACT

A force-transmitting arrangement (4) for a valve train (1) of an internal-combustion engine (2) is provided with hydraulic valve play compensation device (6) with a hollow cylindrical compensation piston (13). This borders, on one end, a working space (28) of the valve play compensation device (6) and, on the other end, a hydraulic medium reservoir (29), which is used for supplying the working space (32) and which is connected to a hydraulic medium supply (18) of the internal-combustion engine (2). Here, a run-off safety device (27) at least partially prevents a hydraulic medium flow from the hydraulic medium reservoir (29) in the direction of the hydraulic medium supply (23). The hydraulic medium reservoir (29) includes an inner storage space (15) enclosed by the compensation piston (13) and at least one outer storage space (52) located outside the compensation piston (13). The run-off safety device (27) is arranged as a component of the force-transmitting arrangement (4) between the hydraulic medium supply (23) and hydraulic medium reservoir (29).

10 Claims, 2 Drawing Sheets

FORCE-TRANSMITTING ARRANGEMENT FOR A VALVE TRAIN OF AN INTERNAL-COMBUSTION ENGINE

FIELD OF THE INVENTION

The invention relates to a force-transmitting arrangement for a valve train of an internal-combustion engine with a hydraulic valve play compensation device with a hollow cylindrical compensation piston. This limits, on one end, a working space of the valve play compensation device and, on the other end, a hydraulic medium reservoir, which is used for feeding the working space and which is connected to a hydraulic medium supply to the internal-combustion engine. Here, a run-off safety device at least partially prevents hydraulic medium from flowing out of the hydraulic medium reservoir in the direction of the hydraulic medium supply.

BACKGROUND OF THE INVENTION

Such force-transmitting arrangements are known to someone skilled in the art of valve controllers with hydraulic valve play compensation and are embodied according to the architecture of the internal-combustion engine. Thus, for the so-called "Overhead Camshaft" valve train construction also known as "OHC" with a camshaft arranged in the cylinder head, for the most part bucket tappets, rocker arms or finger levers, and also stationary pivot bearings for pivot levers are used, each with hydraulic valve play compensation.

In addition, such force-transmitting arrangements also find multipurpose use in the so-called "Overhead Valve" valve train arrangement also known in short as "OHV" predominantly for large-volume internal-combustion engines embodied as V engines. In the OHV arrangement, the valve train is characterized by a camshaft, which is supported in the engine block of the internal-combustion engine in the vicinity of the crankshaft and whose cam lobes are picked up by tappets as force-transmitting arrangements, which can move in the longitudinal direction and which are usually equipped with hydraulic valve play compensation, and are transformed into a stroke movement of each tappet which contacts the cam. The stroke movement of the tappet is typically transmitted to one or more gas-exchange valves allocated to the tappet via a tappet push rod, which activates a rocker arm supported in the cylinder head of the internal-combustion engine.

The known advantages of a hydraulic and thus automatic valve play compensation device includes, in particular, the elimination of the valve play adjustment at the initial assembly and service of the internal-combustion engine, its quiet running, and favorable exhaust-gas emission behavior. However, these advantages can be realized completely only under the assumption that the hydraulic valve play compensation device is functional or ready to function in all operating states, including standstill and starting of the internal-combustion engine. The essential basis for this obviously consists in a suitable supply of hydraulic medium to the valve play compensation device. For this purpose, the hydraulic medium is fed during the operation of the internal-combustion engine by a hydraulic-medium pump via supply lines to a compensation piston of the valve play compensation device, wherein the compensation piston borders a hydraulic pad used for transferring movement or force in a working space. The working space has a variable volume, because the compensation piston is always striving to adjust the height of the hydraulic pad enclosed by the working space, so that mechanical play in the valve train is eliminated during the stroke-free base circle phase of the cam. The compensation piston is typically formed with a hollow cylindrical shape and encloses a hydraulic medium reservoir, which supplies the working space with hydraulic medium via a non-return valve during valve play compensation movements, i.e., for an expanding working space. Here, it has proved to be useful that the volume of the hydraulic medium reservoir equals a multiple of the volume of the working space, in order to reliably exclude undesired suctioning of air or gas bubbles into the working space under all operating conditions of the internal-combustion engine.

A starting process of a cold internal-combustion engine represents an especially critical operating state in this condition, wherein the engine typically was turned off with one or more open gas-exchange valves, so that the compensation pistons of the associated valve play compensation devices have descended partially or completely due to extensive displacement of hydraulic medium from the working space due to the force effect of the gas-exchange valve spring and after a period of temporary standstill phase of the internal-combustion engine. In addition, during the starting process the hydraulic medium pump does not deliver any or a sufficient hydraulic medium volume flow to the compensation piston. In this respect, it is essentially the only task of the hydraulic medium reservoir to completely cover the considerable need for hydraulic medium of the working space during its expansion from the descended position of the compensation piston in its working position. An insufficiently large or an insufficiently filled hydraulic medium reservoir would inevitably lead to suctioning of air or gas bubbles into the working space. The consequences of a working space containing air or gas bubbles are known to someone skilled in the art and are perceived audibly and disruptively as so-called valve tapping primarily due to high contact speeds of the gas-exchange valve during its closing process.

The requirement for a sufficiently large hydraulic medium reservoir is increasingly in contrast with the goal of further reducing the installation space and/or the mass of the force-transmitting arrangement or for expanding the functionality of the force-transmitting arrangement for an unchanged installation space. The latter case includes, in particular, variable force-transmitting arrangements, which are formed as switchable cam followers and can transfer the strokes of various cams selectively to the gas-exchange valve according to the switching state of their coupling means and/or can completely cancel out the stroke of a cam. Thus, it is typical, for example, in switchable tappet push rod valve trains with an OHV arrangement to nest cam follower parts, which can move longitudinally relative to each other and which can be coupled to each other, so that the outer and attachment geometry of the cam follower can remain essentially unchanged. However, this usually requires a reduction in installation space of the hydraulic valve play compensation device and consequently a volume reduction of the hydraulic medium reservoir enclosed by the compensation piston with the previously mentioned risk and consequences of a lack of hydraulic medium supply to the working space.

This problem is often intensified in that the force-transmitting arrangement and with it the compensation piston together with the hydraulic medium reservoir are installed in the internal-combustion engine at an angle to the force of gravity. This can lead to a significant loss of hydraulic medium from the hydraulic medium reservoir, which also endangers successful refilling of the working space, because the hydraulic medium can return via supply openings from the hydraulic medium reservoir into the hydraulic medium supply.

In the state of the art, there are already approaches to solving this intensification of the problem mentioned above. For example, in U.S. Pat. No. 2,688,319, in U.S. Pat. No. 4,462,364, and also in DE 197 54 016 A1, limiting means are proposed, which are supposed to prevent draining of the hydraulic medium reservoir. However, these limiting means are all arranged in the immediate area of the compensation piston and consequently can guarantee at most a filling level corresponding to the hydraulic medium reservoir enclosed directly by the compensation piston. Consequently, it can be necessary, especially for switchable cam followers with reduced installation space compensation pistons, to expand the then insufficiently large hydraulic medium reservoir by cavities located outside the compensation piston. In this case, the limiting means of the cited documents are unsuitable, because they cannot prevent return of hydraulic medium located outside of the compensation piston.

SUMMARY

Therefore, the object of the invention is to provide a force-transmitting arrangement of the type noted above, so that the cited disadvantages are solved with simple means. Accordingly, a sufficiently large hydraulic medium reservoir protected against run-off is available to the working space of the valve play compensation device at all times, in order to guarantee, in particular, a starting and warm running phase of the internal-combustion engine that is free from valve tapping.

This object is achieved according to the invention in that the hydraulic medium reservoir includes an inner storage space enclosed by the compensation piston and at least one outer storage space located outside the compensation piston, wherein the run-off safety device is arranged as a component of the force-transmitting arrangement between the hydraulic medium supply and hydraulic medium reservoir.

This arrangement of the run-off safety device ensures that the hydraulic medium reservoir is sufficiently large, because it still includes one or more outer storage spaces in addition to the hydraulic medium volume enclosed directly by the compensation piston. The hydraulic medium reservoir expanded in this way and protected by the run-off safety device from return of hydraulic medium in the direction of the hydraulic medium supply provides a sufficiently large hydraulic medium volume to the working space, especially for a completely descended compensation piston, for air or gas bubble free expansion of the working space for return of the compensation piston to its valve play free working position.

In another configuration of the invention, the run-off safety device should permit the hydraulic medium flow between a supply opening arranged in the force-transmitting arrangement and the hydraulic medium reservoir in the supply direction and block this flow in the direction opposite the supply direction at least during a base circle phase of a cam which activates the force-transmitting arrangement.

Thus, on one hand, the setting of the hydraulic medium flow direction to a large extent prevents return of hydraulic medium from the hydraulic medium reservoir in the direction of the hydraulic medium supply. On the other hand, the run-off safety device is arranged between the supply opening and the hydraulic medium reservoir and is neutral with respect to installation space in terms of outer contours of the force-transmitting arrangement and is integrated into the force-transmitting arrangement protected from undesired mechanical effects.

Here, it is useful if the run-off safety device includes a slide that can move relative to an inner casing surface of a housing of the force-transmitting arrangement. This slide interacts to form a seal with the inner casing surface and with an outer casing surface of an inner part running within the housing and facing the inner casing surface at least in a blocking position blocking the hydraulic medium flow. Here, the slide can have an arbitrary shape, which in the end depends on the shape of its surroundings, with which it interacts to form a seal either according to the seat valve principle or according to the slide principle.

In a refinement of the invention, pressure should be applied to the slide by the force of a spring in the direction of the blocking position. In this way, for an increased sealing effect, it is guaranteed that the slide can reliably reach the blocking position even for an installation position in the force-transmitting arrangement that is strongly inclined relative to the direction of the force of gravity and/or against external force effects, such as, for example, friction forces.

Furthermore, the slide can be formed as a ring, which is arranged in a hollow cylindrical hydraulic medium channel and which can move in the longitudinal direction of the hydraulic medium channel. Here, the hydraulic medium channel is bordered by the inner casing surface of the housing and the outer casing surface of the inner part. The slide embodied in this way offers considerable advantages to the extent that it can be integrated easily and reliably in terms of function in the already mostly rotationally symmetric force-transmitting arrangements.

In addition, the ring should have a cylindrical outer casing surface, which is concentric to the inner casing surface of the housing at least in the region of the blocking position and which interacts with this inner surface to form a seal. The cylindrical outer casing surface provides a sufficient sealing length between the ring and inner casing surface of the housing and can simultaneously also guarantee the radial guidance of the ring in terms of its tilt-free movement in the longitudinal direction.

In a refinement of the invention, a convex casing surface, which interacts with a first shoulder of the outer casing surface of the inner part to form a seal, should extend between a first end of the ring and an inner casing surface of the ring. Through the convex casing surface, the rocking across the width in the seal contact position due to component tolerances and with respect to these tolerances especially due to deviations in parallelism between the first shoulder and the annular surface contacting the shoulder is limited considerably, so that edge suspension can be avoided.

Furthermore, the force-transmitting arrangement should be formed as a tappet, which activates a hollow cylindrical tappet push rod. Here, a hollow space of the tappet push rod can preferably form an outer storage space of the hydraulic medium reservoir, in that the hollow space of the tappet push rod is in fluid connection with the inner storage space of the compensation piston.

A volume expansion of the hydraulic medium reservoir created in this way is suitable especially for tappets, which are switchable via a locking mechanism. In this case, the housing can move telescopically relative to the inner part against the force of a lost-motion spring. For a locked locking mechanism, a positive fit is created between the housing and the inner part, while for an unlocked locking mechanism, this positive fit is not produced. In this respect, the locking mechanism enables an interruption of the transfer of the movement of the housing to the inner part, which activates the tappet push rod. For the tappet embodied in this way, typically there is only limited installation space available to the compensation piston due to the additional tappet part, so that first the hydraulic medium reservoir expanded by the outer storage space can provide a sufficiently large hydraulic medium volume to the working space.

In a preferred embodiment of the invention, the force-transmitting arrangement has the following combination of features. First, the inner casing surface of the ring should be cylindrical and concentric to a cylindrical section of the outer casing surface of the inner part. Simultaneously, the ring is guided radially on the cylindrical section of the outer casing surface of the inner part. Thus, interlocking of the ring in an annular groove of the housing interacting with the locking mechanism is then prevented, when the locking mechanism is unlocked and the inner part is located relative to the housing in a position, in which the ring is located opposite the annular groove. Furthermore, for the purpose of assembly, the ring is assembled on the inner part from two segments, which each extend over an angle of at least approximately 180°. A hydraulic medium flow in the supply direction is finally enabled such that the inner casing surface of the ring has at least one formation extending over the entire height of the inner casing surface of the ring as a passage cross section for the hydraulic medium.

Finally, pressure should be applied to the ring embodied in this way by the force of spring in the direction of the block position, wherein the spring extends between a second end of the ring, which faces away from the first end, and a second shoulder of the outer casing surface of the inner part.

The invention can be applied advantageously primarily for switchable tappets, which are also arranged in an OHV construction of an internal-combustion engine, because the compensation piston must cover a relatively large path between the descended position and its working position for a correspondingly large refilling need of the working space with hydraulic medium due to the considerable total sum of component tolerances in the OHV construction. Nevertheless, the invention can be used anywhere a sufficiently large hydraulic medium reservoir protected against run-off is to be provided at any time to the working space of the valve play compensation device. In this respect, the invention is also especially effective when a longitudinal axis of the force-transmitting arrangement supported in the internal-combustion engine is inclined to the direction of the force of gravity. Through this configuration, draining of the hydraulic medium reservoir itself can be reliably prevented at extreme inclinations of the force-transmitting arrangement.

BRIEF DESCRIPTION OF THE DRAWINGS

Additional features of the invention result from the following description and from the drawings, in which the force-transmitting arrangement according to the invention is shown as an example with reference to a tappet valve train in OHV arrangement. Shown are.

DETAILED DESCRIPTION OF THE PREFERRED EMBODIMENTS

Figure 1:
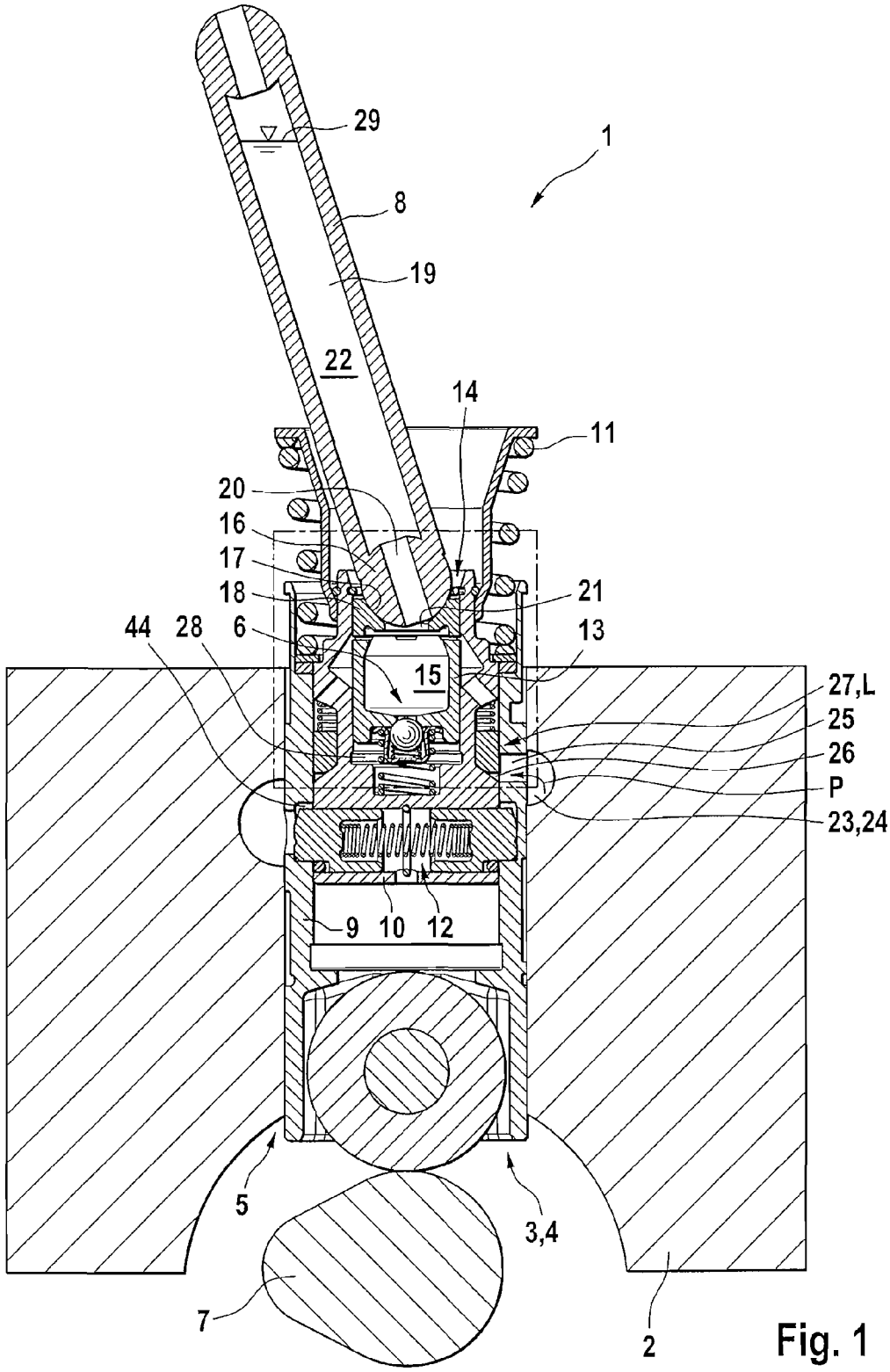
FIG. 1 a longitudinal cross-sectional view of the tappet valve train supported in the internal-combustion engine, FIG. 2 an enlarged view taken at A of the cross-sectional view of FIG. 1 showing the run-off safety device, FIG. 3 a cross-sectional view of a ring of the run-off safety device from FIGS. 1 and 2, and FIG. 4 a plan view of the ring from FIG. 3.

FIG. 1 shows a cross-section of a valve train 1 of an internal-combustion engine 2. Shown is a force-transmitting arrangement 4, which is embodied as a tappet 3 and which is supported so that it can move in the longitudinal direction in a hollow cylindrical guide 5 of the internal-combustion engine 2. The tappet 3 is biased by a hydraulic valve play compensation device 6 between a cam 7 of the internal-combustion engine 2 and a tappet push rod 8 in the longitudinal or stroke direction, as is known to those skilled in the art. The tappet 3 shown here further offers the ability to stop a gas-exchange valve (not shown) that is activated by the valve train 1, such that the transfer of the movement of the stroke originating from the cam 7 to the tappet push rod 8 is interrupted by the tappet 3. For this purpose, a housing 9 of the tappet 3 can move telescopically relative to an inner part 10 against the force of a lost-motion spring 11. For transferring the raised sections of the cam 7 to the tappet push rod 8, the housing 9 is coupled with a positive fit with the inner part 10 in the extended position of the tappet 3 by a locking mechanism according to the illustration. The possibilities that are opened up with the variability of the tappet 3 in terms of fuel consumption and exhaust-gas emission behavior of the internal-combustion engine 2 are also known to the person skilled in the art of internal-combustion engines.

To form such a switchable tappet 3, however, it should be mentioned that typically only a considerably limited installation space is available for a hollow cylindrical compensation piston 13 of the hydraulic valve play compensation device 6. This is because the compensation piston 13 is now arranged in a hollow cylindrical recess 14 of the inner part 10 guided in the housing 9, wherein the radial installation space of the compensation piston 13 is reduced by approximately the sum of the thickness of the housing walls of the inner part 10 surrounding the compensation piston 13. In this respect, the hydraulic medium volume directly enclosed by the hollow cylindrical compensation piston 13 and used as an inner storage space 15 has a significantly limited volume relative to non-switchable tappets.

The tappet push rod 8 is supported in an articulated way with a spherical end 16 in a dome-shaped formation 17 of a piston top part 18 supported on the compensation piston 13. A hollow space 19 of the tappet push rod 8 is in fluid connection via an opening 20 in the spherical end 16 and also via an opening 21 in the piston top part 18 with the inner storage space 15 and forms an outer storage space 22. For limiting the hydraulic medium volume flow into the tappet push rod 8, it is also known to use a so-called throttle plate (not shown), which is typically arranged between the compensation piston 13 and the piston top part 18 and which closes the opening 21 in the piston top part 18 essentially to a cross section that throttles the volume flow. Furthermore, the throttle plate can be formed, for example, by suitable recesses, so that a hydraulic medium volume flow is achieved with low throttling from the tappet push rod 8 in the direction of the compensation piston 13.

A hydraulic medium supply 23, which provides pressurized hydraulic medium in the supply direction "P" in the form of an oil gallery 24 intersecting the guide 5 in the operation of the internal-combustion engine 2, is used to supply the hydraulic valve play compensation device 6. A supply opening 25 arranged in the housing 9 creates a hydraulic connection between the oil gallery 24 and a hollow cylindrical hydraulic medium channel 26 running within the tappet 3 at least in the shown base circle phase of the cam 7. In the hydraulic medium channel 26 there is a run-off safety device 27, which is located in FIG. 1 in a blocking position "L" corresponding to an unpressurized hydraulic medium supply 23 and here blocks a hydraulic medium flow opposite the supply direction "P".

The function of the run-off safety device 27 is to provide a sufficiently large hydraulic medium reservoir 29 especially during the starting phase of the internal-combustion engine 2 to a working space 28 of the valve play compensation device 6 bordered by the compensation piston 13. This is guaranteed in that the hydraulic medium reservoir 29 is protected from draining of hydraulic medium in the direction of the oil gallery 24, i.e., from draining of hydraulic medium into the oil gallery 24 and into the guide 5, during the standstill phase of the internal-combustion engine 2. For this purpose, the run-off safety device 27 is embodied and arranged so that it permits a hydraulic medium flow in the supply direction "P" and blocks flow in the direction opposite the supply direction "P".

Figure 2:
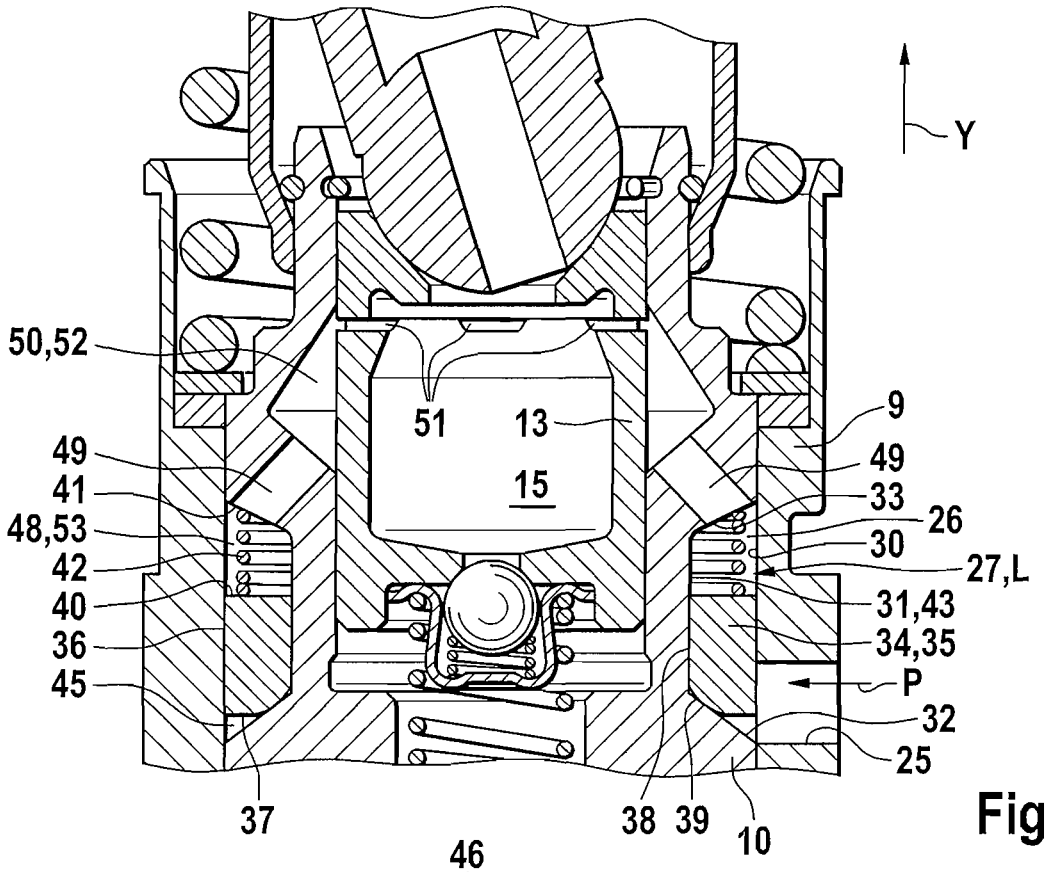

The design and function of the run-off safety device 27 are explained in more detail in FIG. 2 with reference to an enlarged view of the cross-section indicated at A in FIG. 1. The run-off safety device 27 is arranged in the hollow cylindrical hydraulic medium channel 26, which is bordered in the radial direction by an inner casing surface 30 of the housing 9 and an outer casing surface 31 of the inner part 10 and which is bordered in the axial direction, i.e., in the longitudinal direction "Y" by a first shoulder 32 and a second shoulder 33 of the outer casing surface 31 of the inner part 10. The run-off safety device 27 includes a slide 35, which is formed as ring 34 and which can move within the hydraulic medium channel 26 starting from the blocking position "L" in a longitudinal direction "Y".

The hydraulic medium flow against the supply direction "P" is blocked in the shown blocking position "L" such that the ring 34 has a cylindrical outer casing surface 36, which is concentric to the inner casing surface 30 of the housing 9 and interacts with this inner surface to form a seal in the radial direction at least above the supply opening 25. Simultaneously, a casing surface 39, which interacts with the first shoulder 32 of the outer casing surface 31 of the inner part 10 to form a seal in the axial direction, extends between a first end 37 of the ring 34 and an inner casing surface 38 of the ring 34. The casing surface 39 is convex, so that the rocking across the width in the seal contact position due to component tolerances and with respect to these tolerances especially due to deviations in parallelism between the first shoulder 32 and the casing surface 39 is limited considerably, in order to avoid edge suspension between the first shoulder 32 and the casing surface 39.

The spring 42, which applies pressure on the ring 34 in the direction of the blocking position "L", is positioned between a second end 40 of the ring 34 and a second shoulder 41 of the outer casing surface 31 of the inner part 10. In this way, the axial sealing effect of the ring 34 can be increased, in that the force of the spring 42 on the ring 34 counteracts resulting friction forces or compensates for an insufficient force of gravity effect of the ring 34 due to corresponding inclination of the force-transmitting arrangement 4 to the direction of the force of gravity.

Furthermore, the cylindrical inner casing surface 38 of the ring 34 is guided in the radial direction on a cylindrical section 43 of the outer casing surface 31 of the inner part 10, with this cylindrical section being concentric to the inner surface. For a decoupled locking mechanism 12 and in a relative position of the housing 9 to the inner part 10, in which the ring 34 is opposite an annular groove 44 interacting with the locking mechanism 12 (see FIG. 1) in the housing 9, the radial guidance of the ring 34 on the inner part 10 prevents the ring 34 from becoming interlocked with the annular groove 44 through radial displacement. This position, in which the supply opening 25 can be located at least in some sections above the ring 34, is not relevant for the function of the run-off safety device 27 in the block position "L", because the standstill phase of the internal-combustion engine 2 is basically started with a coupled locking mechanism 12 of the then extended tappet 3.

Figure 3:
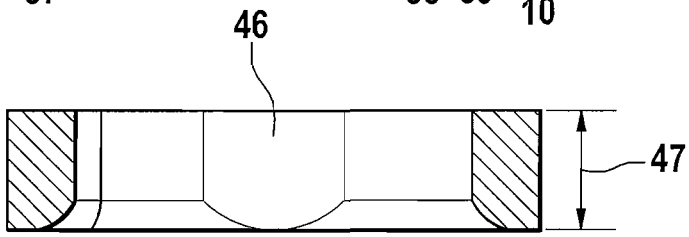
Figure 4:
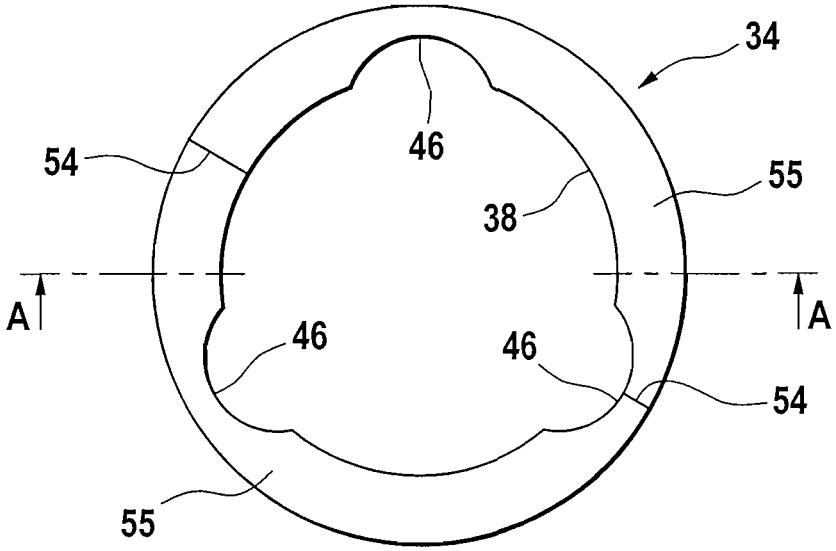

The hydraulic medium flow in the supply direction "P" is realized starting from the explained blocking position "L" of the run-off safety device 27, such that pressurized hydraulic medium located in a bottom annular space 45 of the hydraulic medium channel 26 applies a force on the first end 37 of the ring 34, which is consequently displaced against the force of the spring means 42. Simultaneously, the contact of the casing surface 39 of the ring 34 to the first shoulder 32 of the outer casing surface 31 of the inner part 10 is broken, so that the hydraulic medium can pass by the ring 34 along its inner casing surface 43. As shown in FIGS. 3 and 4, this is realized by cross section-generating formations 46, which are formed in the radial direction on the inner casing surface 38 of the ring 34 and extend over the entire height 47 of the inner casing surface 38.

The hydraulic medium is then led into a top annular space 48 of the hydraulic medium channel 26, which is bordered by the second end 40 of the ring 34 and the second shoulder 41 of the outer casing surface 31 of the inner part 10 and from there via openings 49 of the inner part 10 into an annular channel 50 surrounding the compensation piston 13. Finally, the annular channel 50 is connected via end recesses 51 of the compensation piston 13 to the inner storage space 15 enclosed by the piston.

Consequently, in the explained embodiment the hydraulic medium reservoir 29 includes the inner storage space 15 and the outer storage space 22 and also the outer storage spaces 52 and 53 formed by the annular channel 50 and the top annular space 48, respectively.

In FIGS. 3 and 4 it can also be clearly seen that for assembly reasons, the ring 34 is assembled from two segments 55, which stand opposite each other at the parting seams 54 and which each extend over an angle of 180°. To generate a dimensionally stable unit sealing the hydraulic medium flow, the ring 34 can be joined after assembly on the inner part 10 through suitable positive-fit or non-positive-fit measures, such as, for example, mutual engagement or adhesive or solder connections in the region of the parting seams 54. As an alternative to this two-part configuration of the ring 34, it can also be formed in one part with only one separation seam 54 and can be snapped onto the inner part 10 in the radial direction. Here, an elastic plastic material would be suitable, especially for the latter embodiment of the ring 34.

Although the present invention was described with reference to preferred embodiments, it is not limited to these embodiments, but instead can also obviously be used in other force-transmitting arrangements for valve trains, such as, for example, cup tappets with hydraulic valve play compensation elements and also hydraulic support and plug-in elements, each with or without variability.

LIST OF REFERENCE NUMBERS AND SYMBOLS

1 Valve train
2 Internal-combustion engine
3 Tappet
4 Force-transmitting arrangement

5 Guide
6 Valve play compensation device
7 Cam
8 Tappet push rod
9 Housing
10 Inner part
11 Lost-motion spring
12 Locking mechanism
13 Compensation piston
14 Recess
15 Inner storage space
16 Spherical end
17 Formation
18 Piston top part
19 Hollow space
20 Opening
21 Opening
22 Outer storage space
23 Hydraulic medium supply
24 Oil gallery
25 Supply opening
26 Hydraulic medium channel
27 Run-off safety device
28 Working space
29 Hydraulic medium reservoir
30 Inner casing surface
31 Outer casing surface
32 First shoulder
33 Second shoulder
34 Ring
35 Slide
36 Outer casing surface
37 First end
38 Inner casing surface
39 Casing surface
40 Second end
41 Second shoulder
42 Spring
43 Cylindrical section
44 Annular groove
45 Bottom annular space
46 Formation
47 Height
48 Top annular space
49 Opening
50 Annular channel
51 Recess
52 Outer storage space
53 Outer storage space
54 Parting seam
55 Segment
P Supply direction
L Blocking position
Y Longitudinal direction

The invention claimed is:

1. Force-transmitting arrangement (4) for a valve train (1) of an internal-combustion engine (2) comprising a hydraulic valve play compensation device (6) with a hollow cylindrical compensation piston (13), which borders, on one end, a working space (28) of the valve play compensation device (6) and borders, on another end, a hydraulic medium reservoir (29), which is used for supplying the working space (28) and which is connected to a hydraulic medium supply (23) of the internal-combustion engine (2), wherein a run-off safety device (27) at least partially prevents a hydraulic medium flow from the hydraulic medium reservoir (29) in a direction of the hydraulic medium supply (23), the hydraulic medium reservoir (29) includes an inner storage space (15) enclosed by the compensation piston (13) and at least one outer storage space (52) located outside of the compensation piston (13), wherein the run-off safety device (27) is arranged as a component of the force-transmitting arrangement (4) between the hydraulic medium supply (23) and hydraulic medium reservoir (29), wherein the run-off safety device (27) permits the hydraulic medium flow between a supply opening (25) arranged in the force-transmitting arrangement (4) and the hydraulic medium reservoir (29) in a supply direction (P) and blocks a flow in a direction opposite the supply direction (P) at least during a base circle phase of a cam (7) which activates the force-transmitting arrangement (4), and the run-off safety device (27) includes a slide (35), which can move relative to an inner casing surface (30) of a housing (9) of the force-transmitting arrangement (4) and which interacts with the inner casing surface (30) and with an outer casing surface (31) of an inner part (10) running within the housing (9), that faces the inner casing surface (30), to form a seal at least in a blocking position (L), blocking the hydraulic medium flow.

2. Force-transmitting arrangement according to claim 1, wherein pressure is applied to the slide (35) by the force of a spring (42) in a direction of the blocking position (L).

3. Force-transmitting arrangement according to claim 1, wherein the slide (35) is formed as a ring (34), which is arranged in a hollow cylindrical hydraulic medium channel (26) and which can move in a longitudinal direction (Y) of the hydraulic medium channel (26), wherein the hydraulic medium channel (26) is bordered by the inner casing surface (30) of the housing (9) and the outer casing surface (31) of the inner part (10).

4. Force-transmitting arrangement according to claim 3, wherein the ring (34) has a cylindrical outer casing surface (36), which is concentric to the inner casing surface (30) of the housing (9) at least in a region of the blocking position (K) and which interacts with the inner surface to form a seal.

5. Force-transmitting arrangement according to claim 4, wherein a convex casing surface (39), which interacts with a first shoulder (32) of the outer casing surface (31) of the inner part (10) to form a seal, extends between a first end (37) of the ring (34) and an inner casing surface (38) of the ring (34).

6. Force-transmitting arrangement according to claim 5, wherein the force-transmitting arrangement (4) is formed as a tappet (3) which activates hollow cylindrical tappet push rods (8).

7. Force-transmitting arrangement according to claim 6, wherein the hydraulic medium reservoir (29) includes an outer storage space (22) formed by a hollow space (19) of the tappet push rod (8).

8. Force-transmitting arrangement according to claim 6, wherein the tappet (3) is embodied to be switchable via a locking mechanism (14), which permits an at least a partial break in a transfer of movement of the housing (9) to the inner part (10), in that, for an unlocked locking mechanism (12), the housing (9) can move telescopically relative to the inner part (10), wherein the inner part (10) activates the tappet push rod (8).

9. Force-transmitting arrangement according to claim 8, wherein:

a. the inner casing surface (38) of the ring (34) is cylindrical and concentric to a cylindrical section (43) of the outer casing surface (31) of the inner part (10), b. the ring (34) is guided in the radial direction on the cylindrical section (43) of the outer casing surface (31) of the inner part (10), c. the ring (34) is assembled from two segments (55), which each extend over an angle of at least approximately 180°, d. the inner casing surface (38) of the ring (34) has at least one formation (46) extending over the entire height (47) of the inner casing surface (38) of the ring (34).

10. Force-transmitting arrangement according to claim 9, wherein pressure is applied to the ring (34) by the force of a spring (42) in a direction of the blocking position (L), wherein the spring (42) extends between a second end (40) of the ring (34) facing away from the first end (37) and a second shoulder (41) of the outer casing surface (31) of the inner part (10).

* * * * *